US007656305B2

(12) United States Patent
Kennedy

(10) Patent No.: US 7,656,305 B2
(45) Date of Patent: Feb. 2, 2010

(54) MONITORING SYSTEM

(75) Inventor: George Coulter Kennedy, Kilmacolm (GB)

(73) Assignee: Spicket Valves and Pumps Limited, Scotland (GB)

( * ) Notice: Subject to any disclaimer, the term of this patent is extended or adjusted under 35 U.S.C. 154(b) by 299 days.

(21) Appl. No.: 11/719,259

(22) PCT Filed: Nov. 22, 2005

(86) PCT No.: PCT/GB2005/004475

§ 371 (c)(1),
(2), (4) Date: May 14, 2007

(87) PCT Pub. No.: WO2006/056755

PCT Pub. Date: Jun. 1, 2006

(65) Prior Publication Data

US 2009/0081051 A1 Mar. 26, 2009

(30) Foreign Application Priority Data

Nov. 23, 2004 (GB) ..... 0425688.9

(51) Int. Cl.

| | |
|---|---|
| ***G08B 21/00*** | (2006.01) |
| ***F04B 49/06*** | (2006.01) |
| ***G01L 1/00*** | (2006.01) |
| ***G01L 3/00*** | (2006.01) |
| ***G01L 5/00*** | (2006.01) |

(52) U.S. Cl. ..... 340/665; 417/44.8; 702/42; 73/1.19

(58) Field of Classification Search ..... 73/1.15, 73/1.19–1.23, 787–798, 807–816, 825, 837, 73/840, 855, 857, 862.26, 152.61; 340/665, 340/668; 702/42, 43; 417/44.8
See application file for complete search history.

(56) References Cited

U.S. PATENT DOCUMENTS

| | | | | |
|---|---|---|---|---|
| 2,275,532 | A | 3/1942 | Lamberger et al. | |
| 4,644,785 | A | 2/1987 | Doyle | |
| 5,159,832 | A * | 11/1992 | White | 73/152.61 |
| 5,163,660 | A * | 11/1992 | Yamaoka et al. | 267/136 |
| 5,214,594 | A * | 5/1993 | Tyler et al. | 702/43 |
| 5,377,549 | A | 1/1995 | Werner | |
| 5,591,921 | A * | 1/1997 | Schaede | 73/849 |

(Continued)

FOREIGN PATENT DOCUMENTS

| | | |
|---|---|---|
| GB | 2190170 | 11/1987 |

(Continued)

*Primary Examiner*—Jennifer Mehmood
(74) *Attorney, Agent, or Firm*—Daniel N. Lundeen; Lundeen & Lundeen, PLLC

(57) ABSTRACT

There is disclosed a monitoring system for monitoring alignment of a piston rod assembly of a reciprocating pump, such as those used to pump drilling mud in the oil and gas exploration and production industry. In one embodiment, a monitoring system is disclosed which is for a reciprocating pump (10) of a type comprising a fluid end component (20), a power end component (18), and a piston rod assembly (12) extending between the fluid and power end components. The monitoring system includes a number of sensors (52, 74) coupled to the piston rod assembly, for providing an output indicative that the piston rod assembly is experiencing bending stress, which occurs in the event that the piston rod assembly becomes misaligned, in use of the pump.

37 Claims, 4 Drawing Sheets

U.S. PATENT DOCUMENTS

| | | | | |
|---|---|---|---|---|
| 5,592,386 | A * | 1/1997 | Gaultier | 701/99 |
| 5,904,071 | A | 5/1999 | Kennedy et al. | |
| 6,144,307 | A * | 11/2000 | Elliot | 340/685 |
| 6,204,771 | B1 * | 3/2001 | Ceney | 340/665 |
| 6,216,581 | B1 * | 4/2001 | Murao et al. | 92/5 R |
| 6,922,152 | B2 * | 7/2005 | Sumi et al. | 340/666 |
| 2004/0167738 | A1 * | 8/2004 | Miller | 702/114 |
| 2005/0025631 | A1 * | 2/2005 | Lake | 417/63 |
| 2007/0132603 | A1 * | 6/2007 | Edlund et al. | 340/665 |

FOREIGN PATENT DOCUMENTS

| | | |
|---|---|---|
| GB | 2422879 | 9/2006 |
| GB | 2434843 | 8/2007 |
| WO | 2005035986 | 4/2005 |

* cited by examiner

Cross heads correcly aligned
B
C
A
A

Cross heads mis-aligned
B
D
A
Misalignment
D
E

SKE 1

MONITORING SYSTEM

This invention relates to reciprocating pumps such as those used to pump drilling mud in the oil and gas exploration and production industry, including those pumps commonly referred to in the industry as mud and slush pumps. In particular, the present invention relates to a monitoring system to determine misalignment in the piston rod assembly and in the cross-head mechanism of such pumps.

Within a typical reciprocating pump there is arranged a piston rod assembly which provides a connecting piston rod between the primary dynamic component of the pump's fluid end, the piston, and the dynamic components of the pump's power end. The assembly comprises a power end component, a fluid end component and a connector which is coupled to both end components. Due to the abrasive nature of the slurries which pumps utilised in the oil and gas exploration and production industry must handle and the high reciprocating pressure of such pumps, the piston requires regular replacement and as such the piston rod assembly must be accessible and be easily uncoupled.

This arrangement therefore provides a link over a distance between the cross-heads of the fluid end and the power end of the pump. Accordingly, the pump must be correctly set-up so that no bending force will be induced in the piston rod assembly or in the cross-heads that produce axial motion from rotary movement in the power end of the pump.

FIG. 1 illustrates the link and cross-heads in a typical high pressure (H.P.) reciprocating pump. In FIG. 1(*a*), the cross-heads A,B and the linking piston rod assembly C all lie on a central axis D and are thus aligned. This is the correct set-up. As will be apparent from FIG. 1(*b*), when a misalignment E occurs in the cross-head assembly A, large bending moments and side-thrust are induced in the piston rod assembly C and in the cross-head mechanism B. In turn, the high side loadings are transmitted back into the gear train that drives the cross-heads A,B. All of the afore-mentioned high stresses will typically result in high wear and, not infrequently, failure of the entire drive mechanism, causing the pump to be shut down for a lengthy re-build to be carried out. A misaligned cross-head will also result in premature wear in pistons and cylinder liners. This can result in the abrasive drilling fluid migrating past piston seals and causing damage to components of the pump.

It is therefore amongst the objects of at least one embodiment of the present invention to provide a monitoring system for a reciprocating pump to detect bending stresses.

It is also amongst the objects of at least one embodiment of the present invention to provide a piston rod assembly for a reciprocating pump which includes stress detection.

According to a first aspect of the present invention, there is provided a monitoring system for a reciprocating pump of a type comprising a fluid end component, a power end component, and a piston rod assembly extending between the fluid and power end components, the monitoring system comprising at least one sensor adapted to be coupled to the piston rod assembly, for providing an output indicative that the piston rod assembly is experiencing bending stress.

Preferably, the monitoring system comprises an indicator or indicator means coupled to or otherwise operatively associated with the at least one sensor, for signalling that the piston rod assembly is experiencing bending stress.

The at least one sensor may be arranged in parallel to a central axis of the piston rod assembly.

The at least one sensor may be a stress-measurement sensor.

The pump may be a high pressure reciprocating pump.

According to a second aspect of the present invention, there is provided a monitoring system for a high pressure reciprocating pump, the system comprising one or more stress-measurement sensors, the one or more sensors being arranged in parallel to a central axis through a piston rod assembly located between a fluid end component and a power end component, and indicator means for signalling to a user that the assembly is under bending stress.

Preferably the one or more sensors are strain gauges. When the piston rod assembly experiences a bending load (due to misalignment) and thus a bending stress, this may cause consequent strains to be generated within the piston rod assembly. Accordingly, by providing a sensor in the form of a strain gauge, a detected strain may indicate that the piston rod assembly is experiencing a bending load/stress, and is thus out of alignment. It will be understood that, during normal operation of the pump (when the piston rod assembly is in correct alignment), there may be negligible detectable strain in the piston rod assembly. In particular preferred embodiments, the at least one sensor may comprise or take the form of a semiconductor strain gauge, such as those commercially available from Kyowa Electronics Instrument Company of Japan. Sensors of this type provide outputs up to 500 times greater than other types of strain gauges, such as resistance strain gauges, and are of particular utility in the present invention, where the strains induced in a piston rod assembly through misalignment are relatively small.

Alternatively, the one or more sensors may be load sensing washers or any other suitable sensors. If desired, a combination of types of sensors may be provided.

Preferably the one or more sensors are located at points distal to and thus spaced from a central axis of the piston rod assembly. In this way the earliest warning of stress can be given. For example, strains and bending stresses in the rod assembly increase away from the central axis of the piston rod assembly. Accordingly, by spacing the sensor as far as possible from the central axis, the output of the sensor may be optimised. Additionally, access to the sensor for maintenance/replacement may be facilitated.

Preferably the system includes a power supply. The power supply may be remote to the pump. In this way, all parts of the system except the sensors can be remote from the pump and one or more cables for connection can be run between them. Alternatively the system includes a signal amplifier, the amplifier being mounted with the power supply at or near the pump, such that sensor signals are transmitted to a remote data processing unit.

The indicator/indicator means may comprise an audible warning system which provides an audible signal when a sensor records a stress measurement over a pre-determined level. Optionally the indicator includes a visual display. The indicator may be local or remote from the piston rod assembly.

The system may comprise a connector for coupling the at least one sensor to a remote location, in particular to the indicator. The connector may be a cable, wire or the like. The at least one sensor may be coupled to the indicator, which may take the form of a personal computer (PC) or the like, for data storage, review and/or analysis. In an alternative, the system may comprise a data transmission device for transmitting data from the sensor to a remote location. For example, the data transmission device may be adapted to transmit data to the indicator, which may be a PC, to facilitate generation of a signal indicative that the piston rod assembly is experiencing bending stress. The data transmission device may comprise a transmitter for transmitting an electromagnetic signal (such as a radio frequency or microwave signal) and a suitable remote receiver. This may avoid a requirement to provide a hard connection between the sensor and the remote location.

The system may additionally comprise a data recordal device for recording data from the at least one sensor. This may facilitate monitoring of data output from the sensor over a period of time, which may indicate that the piston rod assembly is approaching a condition where it is out of alignment. The data recordal device may comprise a chart recorder or plotter.

The system may include attachment means so that the system can be retro-fitted to existing piston/power rod assemblies. The attachment means may be adhesive. Alternatively the attachment means may be a mechanical connection.

According to a third aspect of the present invention, there is provided a piston rod assembly for coupling between a power end and a fluid end of a reciprocating pump, the piston rod assembly comprising:

a power end component; a fluid end component;

at least one clamping member having a first end adapted to be coupled to the power end component and a second end adapted to be coupled to the fluid end component, for coupling the power and fluid end components together; and a tensioning device for generating a force to secure the power and fluid end components against release.

The piston rod assembly may comprise a monitoring system for indicating that the piston rod assembly is experiencing bending stress. In preferred embodiments, the monitoring system may comprise a monitoring system according to the first or second aspect of the present invention.

The at least one clamping member may be arranged relative to a rod axis between the power and fluid ends. The tensioning device may be a tensioning means and may comprise a piston adapted to provide a load orthogonal to an axis of the piston rod assembly to thereby secure the power and fluid end components against release.

According to a fourth aspect of the present invention there is provided a piston rod assembly for coupling between a power end and a fluid end of a high pressure reciprocating pump, the assembly comprising one or more clamping members arranged relative to a rod axis between the power end and the fluid end, each member having a first end adapted to grip a power end component and a second end adapted to grip a fluid end component, at least one member including one or more tensioning means, a monitoring system, wherein said tensioning means comprise a piston to provide a load in said tensioning means orthogonal to said first rod axis and thereby secure said components against release.

Preferably the monitoring system is according to the first or second aspect.

Preferably the clamping members are part cylindrical bodies which when coupled together or arranged on the rod axis provide a substantially cylindrical body.

Preferably there are two clamping members, an upper clamping member and a lower clamping member. However, any suitable number of clamping members may be provided.

Preferably the first and second clamping member ends each include a contact face which, in use, is disposed parallel to an axis of the piston rod assembly on an inner surface thereof. The face may provide a recess on the inner surface in which a portion of the power end component or fluid end component may be located such that the component is gripped and held when the clamping member is coupled to the power and fluid ends. Where the assembly comprises two clamping members, the clamping members may be adapted to be brought together by the tensioning device/means, for gripping the power and fluid end components. Advantageously each component end and the first/second end provide a knuckle joint. Alternatively, they may provide a ball and socket.

Where the tensioning device/tensioning means comprises a piston adapted to provide a load orthogonal to an axis of the piston rod assembly to thereby secure the power and fluid end components against release, each piston may be slideable within an hydraulic cylinder. Each piston may include a stem adapted to receive a nut or a lock. Said stems may extend from one clamping member through an aperture in an adjacent clamping member. The nut may then engage the stem to couple the clamping members together. Also, a spring may be arranged within the hydraulic cylinder to tension the said stem. Advantageously, the assembly includes non-rotational means for preventing rotation of said stem. The non-rotational means may be a pin locating in a matching recess arranged parallel to the stem.

A space may be defined between a base of the cylinder and a base of the piston for accommodating hydraulic fluid. The assembly may include a fluid inlet port to permit the input of hydraulic fluid to the cylinder. Advantageously a chamber may be included in each member to provide a common feed for hydraulic fluid to all cylinders within the member.

According to a fifth aspect of the present invention, there is provided a pump comprising a monitoring system according to one of the first and second aspects of the invention.

According to a sixth aspect of the present invention, there is provided a pump comprising a piston rod assembly according to one of the third and fourth aspects of the present invention.

The features of one or more of the above aspects of the present invention may optionally be provided together or in combination. Thus one or more features of the first/second aspect of the invention may be provided in combination with one or more features of the third/fourth aspect of the invention.

Further features of the invention are defined in the appended claims.

Embodiments of the present invention will now be described, by way of example only, with reference to the accompanying drawings, in which.

Figure 1:
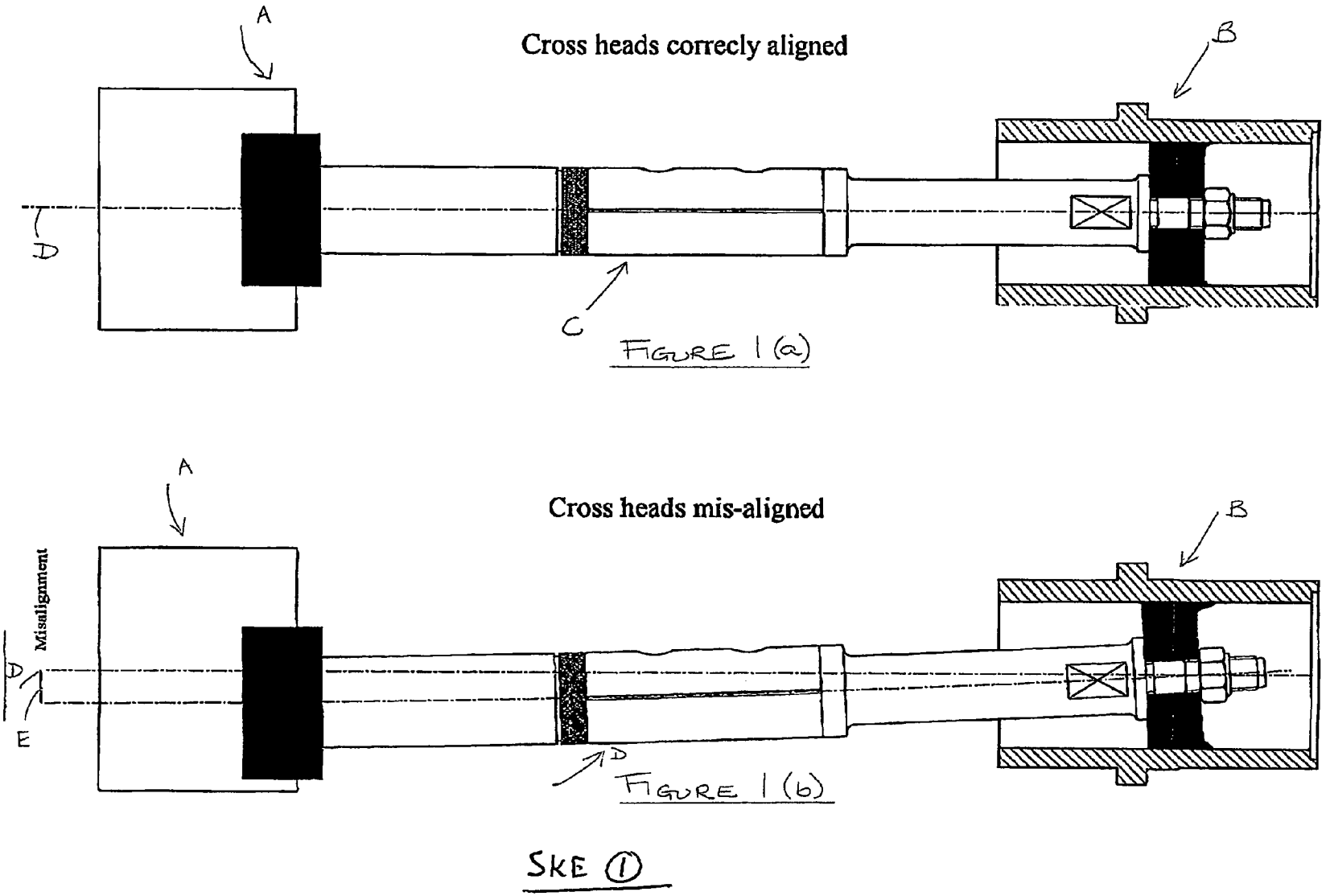
FIG. 1 is a schematic view of a portion of a high pressure reciprocating pump including a piston rod assembly and cross-heads, shown in an (a) aligned and (b) misaligned configuration.
Figure 2A:
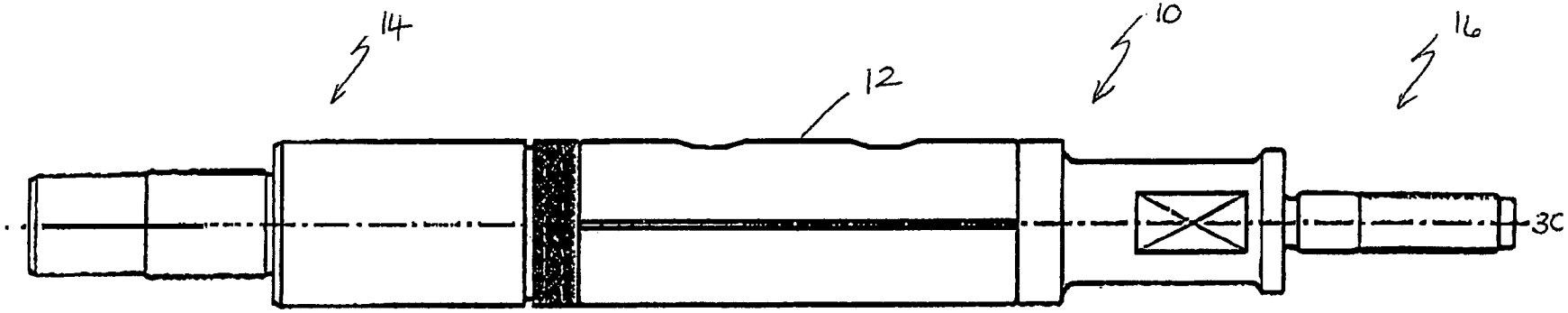
FIG. 2(*a*) is a schematic view of a portion of a high pressure reciprocating pump including a piston rod assembly, FIGS. 2(*b*) and 2(*c*), according to a first embodiment of the present invention.
Figure 2B:
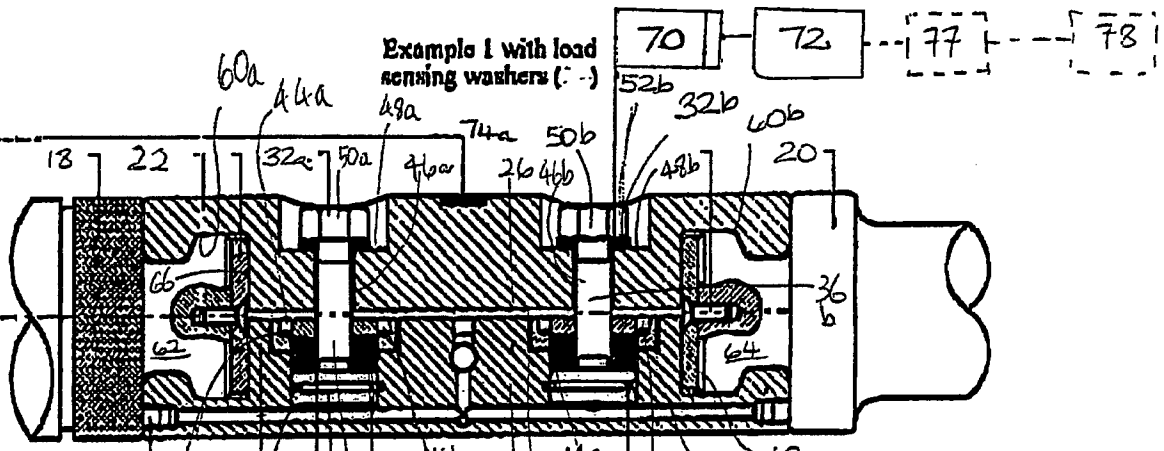
Figure 2C:
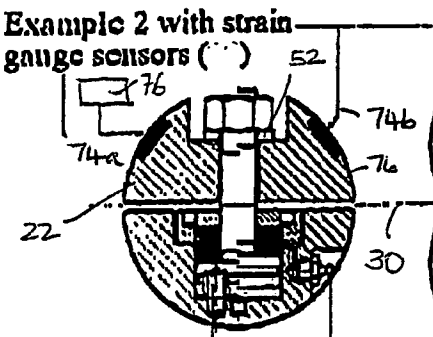

Referring initially to FIG. 2 of the drawings there is illustrated a portion of a high pressure reciprocating pump, generally indicated by reference numeral 10, including a piston rod assembly 12, according to a first embodiment of the present invention, located between a power end 14 and a fluid end 16 of the pump 10.

Referring now to FIGS. 2(*b*) and (*c*), the piston rod assembly 12 may be considered as a clamping link by virtue of its purpose i.e. to provide a releasable coupling between the power end component 18 and the fluid end component 20 which is secure during the high reciprocating force applied by the pump. Assembly 12 is based on the assembly presented in Applicant's International Patent Application No. PCT/GB2004/004260 (published as WO2005/035986).

Assembly 12 comprises two clamping members in the form of half-cylindrical clamps 22,24. Each clamp 22,24 has an inner planar surface 26,28 respectively. The surfaces 26,28 are arranged on and lie parallel to the rod axis 30. The rod axis is a central line located between the end components 18,20.

The piston rod assembly 12 includes two tensioning modules 32*a,b* to connect the clamps 22,24. Each tensioning module includes a piston 34*a,b*, a piston stem 36*a,b*, and a disc spring stack 38*a,b* arranged within a cylindrical housing 40*a,b* within the lower clamp 24. These elements 34, 36, 38 are all disposed orthogonally to the rod axis 30 of the assembly 12. Covers 42*a,b*, held in place by screws 44*a-d*, close the housings 40*a,b* retaining the spring force. The upper clamp 22 includes apertures 46*a,b* through which extend the stems 36*a,b* from the lower clamp 24. Each aperture 46 widens to provide a lip 48*a,b* parallel to the rod axis 30. A nut 50*a,b* is screwed to the stem 36*a,b* and may be tightened against the lip 48*a,b*.

Below each piston 34*a,b* in a space defined by the base of the piston 34*a,b* and the base of the housing 40*a,b* is a fluid chamber 50*a,b*. Hydraulic fluid 52 may enter this chamber 50 and exert a force upon the piston 34*a,b*. The chambers are connected to a fluid line 54 located along the length of the assembly 12. The fluid line 54 is sealed, but includes an inlet port 56 illustrated in FIG. 2(*c*). Also shown in FIG. 2(*c*) is a pin 58 which prevents the piston 34 from turning in the housing 40.

Returning to FIG. 2(*b*), the inner surfaces 26,28 at the ends of the clamps 22,24 are shaped such that, when the clamps 22 and 24 are brought together, recesses 60*a,b* are defined between the clamps at each end thereof. These recesses 60*a,b* take the form of circumferential grooves which extend around the inner surfaces 26,28 equidistantly from the rod axis 30. Each component end 18,20 includes a protrusion 62,64 (shown in part-section) which may be likened to a knob or knuckle in profile, and these protrusions 62,64 fit into the recesses 60*a*,60*b* and are effectively gripped by the clamps 22,24. In this way, when the clamps 22, 24 are coupled together, the power end component 18 is secured relative to the fluid end component 20. To aid the fitting of each protrusion 62,64 into each recess 60*a,b*, bearing pads 66,68 are located at the distal ends of the protrusions 62,64. The bearing pads 66,68 may be formed of a material which provides some give and has a relatively high elastic modulus. The bearing pads 66, 68 are typically of a plastics material such as Acetyl, with a low moisture absorption rate (around 1%). Minor swelling of the pads 66, 68 provides an interference fit which eases assembly of the piston rod assembly 10 by a single operator.

This assembly 12 advantageously applies a force orthogonal to the rod axis 30 so that a greater force is applied to grip the fluid and power end components 18,20.

Located between each nut 50*a,b* and the corresponding lip 48*a,b*, is a load sensing washer 52*a,b*. Each washer 52 is connected to a power supply 70 including a signal amplifier. In turn a computer 72 displays the measurement of the load upon each of the washers 52. Additional strain gauges 74*a,b* are mounted on an outer surface 76 of the upper clamp 22. The gauges 74*a,b* are also connected to power supply 70 and their measurements displayed on the monitor of the computer 72 and the gauges 74 and washer 52 are coupled to the computer 72 by appropriate cable or wires. The computer 72 typically includes an analogue/digital converter, for converting analogue signals output by the sensors 52,74 into digital signals for processing by the computer 72. Alternatively, the signals output by the sensors 52,74 may be converted by known means to current signals, for example for transmission over a 4-20 mA current loop. The strain gauges 74*a,b* take the form of semiconductor strain gauges, such as those available from Kyowa Electronics Instrument Company of Japan, which provide strong signal outputs in response to small applied strains on the piston rod assembly 12 due to misalignment bending stresses. The strain gauges 74 will detect any strain indicative of bending stresses applied to the piston rod assembly 12 or experienced by the power train of the pump 10, shown in FIG. 2(*a*). The position at which the strain gauges 74 are mounted is selected on the basis of the highest likely bending stress in the assembly 12.

Alternatively, the signals output by the sensors may be converted by known means to current signals e.g. for transmission over a 4.20 mA loop.

The power supply 70 and the signal amplifier provide a signal that will be used to calibrate the system and provide a continuous visual display—locally and remotely—of bending stress. Signal alarm sensors will provide warning of an excessive increase in bending stress and thus allow remedial action to be taken to remedy any misalignment in the power train.

The sensors 52,74 can be easily fitted to the rod assembly 12 without requiring any alteration to the rod design. This allows the monitoring system to be retrofitted and easily removed and mounted on another pump if required. Additionally, the sensors can be replaced in event of damage.

In a variation, the piston rod assembly 12 includes a data transmission device 76 such as a radio frequency or microwave transmitter, which transmits data from the sensors 52,74 to a remotely located receiver 77. Thus data from the sensors 52,74 indicative that the piston rod assembly 12 is experiencing bending stress may be transmitted to the receiver for suitable output.

The piston rod assembly 12 also optionally includes a data recordal device in the form of a chart recorder or plotter 78 for recording output sensor data. This facilitates monitoring of data output from the sensors 74*a,b* over a period of time, which may indicate that the piston rod assembly 12 is approaching a condition where it is out of alignment.

Figure 3A:
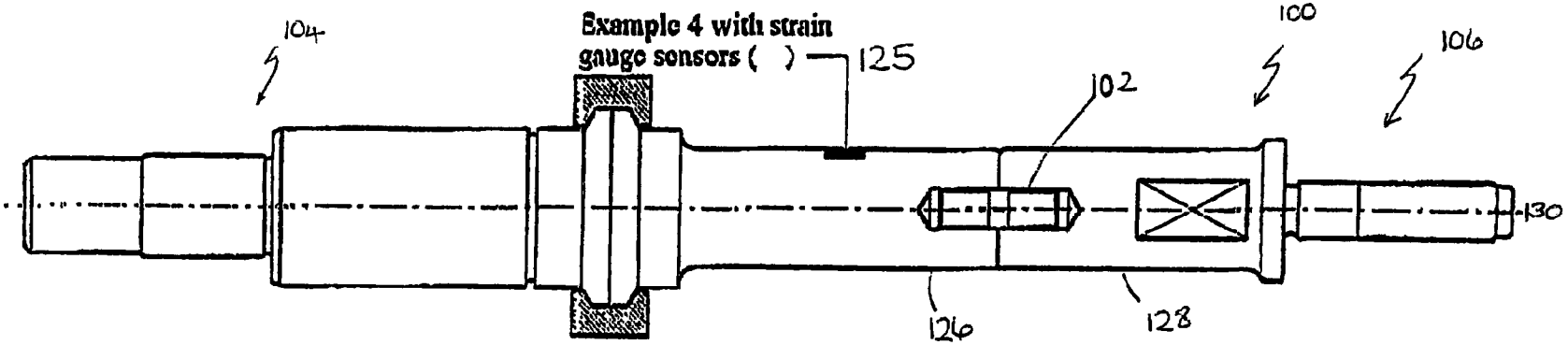
FIG. 3(*a*) is a schematic view of a portion of a high pressure reciprocating pump including a piston rod assembly, FIG. 3(*b*), according to a second embodiment of the present invention.
Figure 3B:
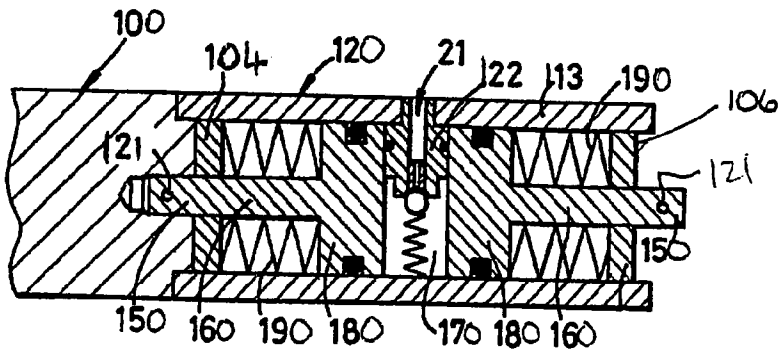

Reference is now made to FIG. 3(*a*) of the drawings which illustrates a portion of a high pressure reciprocating pump, generally indicated by reference numeral 100, including a piston rod assembly 102, according to a second embodiment of the present invention, located between a power end 104 and a fluid end 106 of the pump 100. The rod assembly 102 is as described in UK Patent Application GB 2190170, the disclosure of which is incorporated herein by way of reference.

Referring now to FIG. 3(*b*), the H.P. reciprocating pump 100 has a composite piston rod comprising a power end component 104, a fluid end component 106 and a connector 120 releasably connected to said end components. The connector 120 has a pair of tensioned links 150 extending therefrom and apertures 120 in the components and respective links co-operate for location of a locking pin therein. Pressure means 160, 170, 180, 190 within the connector causes movement of the links against tension to permit coupling or uncoupling and for returning the links under tension to secure the components when coupled against release. The coupling means comprises a valve 122 provided in the body 113 of the connector 120 to inject or release pressure fluid into or out of a space 170 between two pistons 180 which form the links. In use, fluid supplied under pressure into the space 170 acts on rear faces of the pistons 180, to translate the pistons in axially opposite directions. This movement aligns apertures 121 in the pistons 180 with corresponding apertures (not shown) in the power and fluid end components 104, 106. The connector 120 may then be securely coupled to the power and fluid end components 104, 106 by pins (not shown) located within the aligned apertures. Subsequent bleeding of fluid from the space 170 causes springs 190 to act upon the pistons 180, thereby generating retaining tension forces on the power and fluid end components 104, 106 to securely couple the components together.

Returning to FIG. 3(*a*), a strain gauge 125 is located on connector 126, in which the rod assembly 102 is mounted. Although only one gauge is shown, it will be appreciated that gauges may be placed over the outer surface 128 at any location over the power train shown in FIG. 3(*a*). Advantageously the gauge 125 is located on the outer surface 128, distal to the rod axis 130, as any bending stress applied to the train will be amplified at distances furthest from the axis 130. The gauges 125 will be linked to a power supply and monitor as shown in FIG. 2(*b*).

In this arrangement no modification is required to the rod assembly 102. The monitoring system may be retrofitted by mounting the gauges on the outer surface 128. A groove may be machined on the outer surface so that the gauges and other components can be located in a recess with an optional protective covering for safety. It will be appreciated that the gauges may be mounted by any means such as adhesive or they may be screwed/bolted to the surface 128.

Figure 4A:
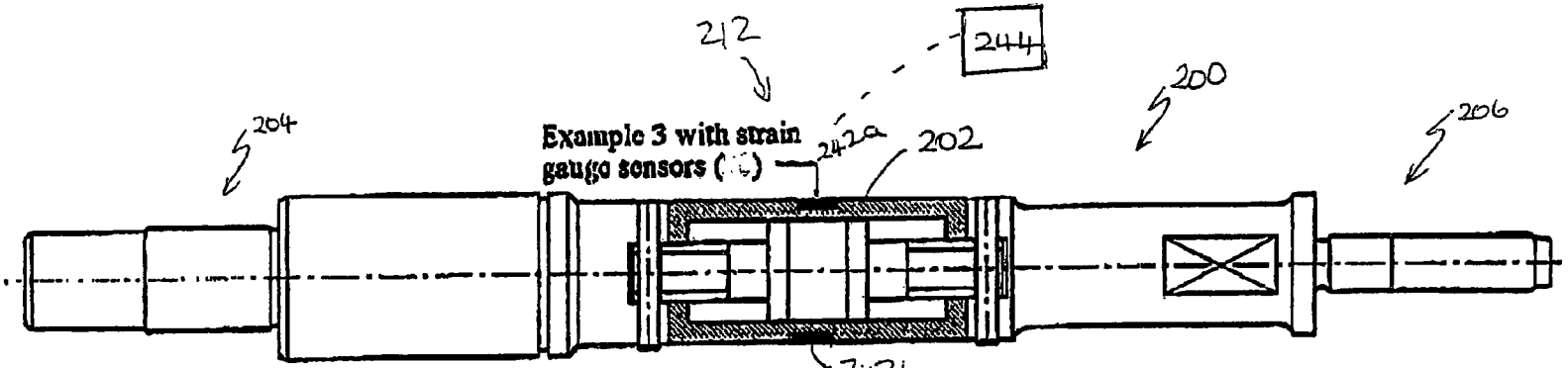
FIG. 4(*a*) is a schematic view of a portion of a high pressure reciprocating pump including a piston rod assembly, FIG. 4(*b*), according to a third embodiment of the present invention.
Figure 4B:
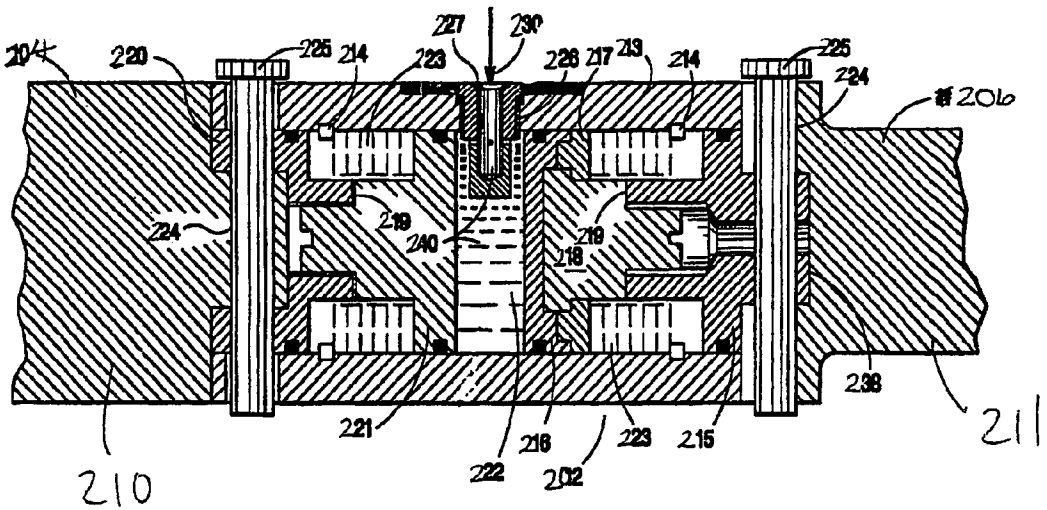

Reference is now made to FIG. 4(*a*) of the drawings which illustrates a portion of a high pressure reciprocating pump, generally indicated by reference numeral 200, including a piston rod assembly 202, according to a third embodiment of the present invention, located between a power end 204 and a fluid end 206 of the pump 200. The rod assembly 202 is as described in U.S. Pat. No. 5,904,071 the disclosure of which is incorporated herein by way of reference. Rod assembly 202 is an improvement over the assembly of the second embodiment, FIG. 3.

Referring to FIG. 4(*b*), assembly 202 has a cylindrical body 213 and two spring retainers 214. A male tension link 215 projects axially from one end of the assembly The male link 215 is the rotatable outer portion of a piston 216 and is connected to the piston 216 by means of a shoulder 217, a swivel link 218 and adjustment shims A female tension link 220 is contained axially within the body 213 at the opposite end to that containing the male link 215. The female link 220 is the outer portion of a non rotating piston 221. Pistons 216 and 221 are located within the body 213 in back-to-back relation such that a chamber 222 is provided between the two pistons 216 and 221. Spring means, such as disc springs 223 between the respective pistons 216 and 221 and spring retainers 214 resist outward movement of the pistons 216, 221. Thus, the pistons 216, 221 are normally in their withdrawn position with the links 215 and 220 being pushed by the springs. 223 into the body 213.

When chamber 222 is pressurised by fluid 240 the pistons 216 and 221 are forced outwards for a short distance just sufficient to bring a pin aperture 224 in each link into register with a similar opening in the two end components 210, 211 after which a pin 225 is inserted into each of the through apertures 224.

When pressure in the chamber 222 is released by bleeding fluid 240 from the chamber, the pistons 216, 221 are pushed inwards by the springs 223 thus placing in shear the pins 225 and retaining the end components 210, 211 securely attached to the connector 212. The operation of coupling the end components 210, 211 to the release link connector 212 takes approximately thirty seconds. To uncouple, the chamber 222 is again pressurised to release the shear force on the locking pins 225 which can then be easily removed out of the apertures 224. The couplings can be removed, the piston changed, and the rod re-assembled in less than five minutes.

Mounted centrally on the assembly are a pair of strain sensors 242*a,b*. Sensors 242 are oppositely arranged and orthogonal to the port 227. They are kept away from the port 227 to prevent any stress induced by fluid flow having an effect on the bending stress measurement to the power train. Any bending stress experienced by the power train shown in FIG. 4(*a*) will be detected preferentially on one of the sensors 242*a,b* due to their arrangement. The signal from the strain sensor can be sent to a remote site 244 by any communication system known in the art. In this way the monitoring of bending stress in the pump 200, can be integrated with other monitoring systems used on an oil rig/platform. An acceptable limit of bending stress can be set so that a warning signal is provided if the pump is operating over this limit. This allows maintenance to be undertaken to correct the alignment of the power train.

In use, the sensors are located on the piston rod assembly, as described hereinbefore. This may be a retrofit or they may be put in place during manufacture. The sensors are mounted so as not to interfere with the operation of the piston rod assembly. In this way, the pump can operate with or without monitoring being undertaken. When monitoring is required, a signal is either detected from the sensors remotely, or cables can be connected to the sensors and data read from them. If cables are used, it is preferable to stop the pump and adjust the piston rod manually to obtain the stress signals. This signal monitoring over short periods with the pump off, will provide stress measurements at predetermined times. A chart recorder or computer may be used to display the measured data and thus indicate the stress measured. This method provides a cheap and simple monitoring system if desired.

Alternatively, the sensors can be run continuously on the piston rod assembly with the pump on. This will provide continuous data collection and offers the opportunity of immediate warning of a stress level being reached. However it has been found that regular monitoring at set time periods provides effective determination of stress.

The principal advantage of the present invention is that it provides a monitoring system to a pump rod assembly for safe use of the assembly.

Further advantages of the present invention are that an alarm can be used to give a warning of excessive stress before direct or secondary failure has occurred; continuous monitoring of stresses is possible even while the pump is in operation; and monitoring extends the pump and liner life.

Yet further in the first embodiment, an advantage is found in that the system can be used to ensure correct tensioning of the clamping arrangement.

Modifications may be made to the invention herein described without departing from the scope thereof. For example, the number and type of sensors may be varied depending on the environment of the pump and space available for mounting.

The invention claimed is:

1. A monitoring system for a reciprocating pump of a type comprising a fluid end component, a power end component, and a piston rod assembly extending between the fluid and power end components, the monitoring system comprising at least one sensor adapted to be coupled to the piston rod assembly, for providing an output indicative that the piston rod assembly is experiencing bending stress.

2. A system as claimed in claim 1, comprising an indicator coupled to the at least one sensor, for signaling that the piston rod assembly is experiencing bending stress.

3. A system as claimed in claim 1, wherein the at least one sensor is arranged in parallel to a central axis of the piston rod assembly.

4. A system as claimed in claim 1, comprising at least one stress-measurement sensor.

5. A system as claimed in claim 1, wherein the system comprises at least strain gauge sensor.

6. A system as claimed in claim 5, wherein the sensor is a semiconductor strain gauge sensor.

7. A system as claimed in claim 1, wherein the system comprises at least one load sensing washer.

8. A system as claimed in claim 1, wherein the at least one sensor is located at a point distal from a central axis of the piston rod assembly.

9. A system as claimed in claim 1, comprising a power supply remote to the pump.

10. A system as claimed in claim 1, comprising a power supply and a signal amplifier, the amplifier being mounted with the power supply such that sensor signals are transmitted to a remote data processing unit.

11. A system as claimed in claim 1, comprising an indicator coupled to the at least one sensor, for signaling that the piston rod assembly is experiencing bending stress, the indicator comprising an audible warning system which provides an audible signal when a sensor records a stress measurement over a pre-determined level.

12. A system as claimed in claim 11, wherein the indicator includes a visual display.

13. A system as claimed in claim 11, wherein the indicator is remote from the piston rod assembly.

14. A system as claimed in claim 1, comprising a data transmission device for transmitting data from the sensor to a remote location.

15. A system as claimed in claim 14, comprising an indicator coupled to the at least one sensor, for signaling that the piston rod assembly is experiencing bending stress, and wherein the data transmission device is adapted to transmit data to the indicator, to facilitate generation of a signal indicative that the piston rod assembly is experiencing bending stress.

16. A system as claimed in claim 14, wherein the data transmission device comprises a transmitter for transmitting an electromagnetic signal and a remote receiver.

17. A system as claimed in claim 1, comprising a data recordal device for recording data from the at least one sensor.

18. A system as claimed in claim 1, comprising attachment means for retro-fitting the system to an existing piston rod assembly.

19. A piston rod assembly for coupling between a power end and a fluid end of a reciprocating pump, the piston rod assembly comprising:

a power end component;

a fluid end component;

at least one clamping member having a first end adapted to be coupled to the power end component and a second end adapted to be coupled to the fluid end component, for coupling the power and fluid end components together;

a tensioning device for generating a force to secure the power and fluid end components against release; and a monitoring system comprising at least one sensor adapted to be coupled to the piston rod assembly for providing an output indicative that the piston rod assembly is experiencing bending stress.

20. An assembly as claimed in claim 19, wherein the at least one clamping member is arranged relative to a rod axis between the power and fluid ends.

21. An assembly as claimed in claim 19, wherein the tensioning device comprises a piston adapted to provide a load orthogonal to an axis of the piston rod assembly to thereby secure the power and fluid end components against release.

22. An assembly as claimed in claim 19, comprising a plurality of clamping members, wherein the clamping members are part cylindrical bodies which when coupled together provide a substantially cylindrical body.

23. An assembly as claimed in claim 19, comprising two clamping members, an upper clamping member and a lower clamping member.

24. An assembly as claimed in claim 19, comprising first and second clamping members, the ends of each clamping member including a contact face on an inner surface thereof which, in use, is disposed parallel to an axis of the piston rod assembly.

25. An assembly as claimed in claim 24, wherein the faces include recesses on the inner surface in which a portion of the power end component and fluid end components are located such that the components are gripped and held when the clamping member is coupled to the power and fluid ends.

26. An assembly as claimed in claim 19, comprising two clamping members, the clamping members adapted to be brought together by the tensioning device for gripping the power and fluid end components.

27. An assembly as claimed in claim 19, wherein each of the power end and fluid end components and the first and second ends of the clamping member provide a knuckle joint.

28. An assembly as claimed in claim 19, wherein each of the power end and fluid end components and the first and second ends of the clamping member provide a ball and socket joint.

29. An assembly as claimed in claim 19, wherein the tensioning device comprises a piston adapted to provide a load orthogonal to an axis of the piston rod assembly to thereby secure the power and fluid end components against release, and wherein the piston is slideable within an hydraulic cylinder.

30. An assembly as claimed in claim 29, wherein the piston includes a stem adapted to receive a locking element.

31. An assembly as claimed in claim 30, wherein the stem extends from one clamping member through an aperture in an adjacent clamping member.

32. An assembly as claimed in claim 30, wherein a spring is arranged within the hydraulic cylinder to tension the stem.

33. An assembly as claimed in claim 30, including non-rotational means for preventing rotation of the stem.

34. An assembly as claimed in claim 29, wherein a space is defined between a base of the cylinder and a base of the piston for accommodating hydraulic fluid.

35. A pump comprising a monitoring system according to claim 1.

36. A pump comprising a piston rod assembly according to claim 19.

37. A monitoring system for a high pressure reciprocating pump, the system comprising one or more stress-measurement sensors, the one or more sensors being arranged in parallel to a central axis through a piston rod assembly located between a fluid end component and a power end component, and indicator means for signaling to a user that the assembly is under bending stress.

* * * * *